US010134263B2

(12) United States Patent
Rutter et al.

(10) Patent No.: US 10,134,263 B2
(45) Date of Patent: Nov. 20, 2018

(54) MULTI ALARM REMOTE MONITORING SYSTEM

(71) Applicant: Sprue Safety Products Ltd., Coventry (GB)

(72) Inventors: Nicholas Rutter, Coventry (GB); Chris Bolger, Coventry (GB); Peter Brigham, Coventry (GB)

(73) Assignee: SPRUE SAFETY PRODUCTS LTD., Coventry (GB)

( * ) Notice: Subject to any disclaimer, the term of this patent is extended or adjusted under 35 U.S.C. 154(b) by 0 days.

(21) Appl. No.: 15/539,296

(22) PCT Filed: Dec. 29, 2015

(86) PCT No.: PCT/GB2015/054174

§ 371 (c)(1),
(2) Date: Jun. 23, 2017

(87) PCT Pub. No.: WO2016/108047

PCT Pub. Date: Jul. 7, 2016

(65) Prior Publication Data

US 2018/0025618 A1 Jan. 25, 2018

(30) Foreign Application Priority Data

Dec. 29, 2014 (GB) ..... 1423300.1

(51) Int. Cl.
*G08B 23/00* (2006.01)
*G08B 25/00* (2006.01)
(Continued)

(52) U.S. Cl.
CPC ..... *G08B 25/006* (2013.01); *G08B 25/14* (2013.01); *G08B 31/00* (2013.01);
(Continued)

(58) Field of Classification Search
CPC .... G08B 25/006; G08B 13/00; G08B 19/005; H04M 11/04; H04L 41/0631
(Continued)

(56) References Cited

U.S. PATENT DOCUMENTS 7,015,806 B2 * 3/2006 Naidoo ..... G08B 13/19656 340/506
8,049,613 B2 * 11/2011 Poder ..... G08B 13/2491 340/3.1
(Continued)

FOREIGN PATENT DOCUMENTS

CN 202816112 U 3/2013
EP 2128834 A1 12/2009
(Continued)

OTHER PUBLICATIONS

United Kingdom Search Report issued by IPO in connection with GB1423300.1 dated May 12, 2015.

*Primary Examiner* — Toan N Pham
(74) *Attorney, Agent, or Firm* — Levenfeld Pearlstein, LLC

(57) ABSTRACT

A remote alarm monitoring system (10) for recording and processing alarm event data. The alarm system (10) comprises one or more alarm devices (12) in connection with an interface (14), wherein the interface (14) is configured to receive alarm event data; a server (18) in communication with the interface (14), wherein the server (18) is configured to receive and process alarm event data from the interface (14); and one or more networked client devices (22) in communication with the server (18), wherein the server (18) is configured to transmit a message to the networked client device (22), said message based upon the processed alarm event data.

19 Claims, 2 Drawing Sheets

(51) Int. Cl.

| | |
|---|---|
| ***G08B 25/14*** | (2006.01) |
| ***G08B 31/00*** | (2006.01) |
| *G08B 21/04* | (2006.01) |
| *G08B 25/08* | (2006.01) |
| *G08B 29/02* | (2006.01) |

(52) U.S. Cl.
CPC ..... *G08B 21/0423* (2013.01); *G08B 25/08* (2013.01); *G08B 29/02* (2013.01)

(58) Field of Classification Search
USPC ..... 340/517, 506, 541
See application file for complete search history.

(56) References Cited

U.S. PATENT DOCUMENTS

| | | | | |
|---|---|---|---|---|
| 8,988,232 | B1 | 3/2015 | Sloo et al. | |
| 2002/0118107 | A1 | 8/2002 | Yamamoto et al. | |
| 2006/0001741 | A1 | 1/2006 | Hsu et al. | |
| 2008/0204190 | A1* | 8/2008 | Cohn ..... | G05B 23/027 340/3.1 |
| 2011/0001812 | A1 | 1/2011 | Kang et al. | |
| 2011/0169637 | A1 | 7/2011 | Siegler et al. | |
| 2011/0254681 | A1 | 10/2011 | Perkinson et al. | |
| 2014/0201315 | A1 | 7/2014 | Jacob et al. | |
| 2014/0258727 | A1 | 9/2014 | Schmit et al. | |
| 2015/0029020 | A1* | 1/2015 | Bailey ..... | G08B 25/001 340/502 |

FOREIGN PATENT DOCUMENTS

| | | | |
|---|---|---|---|
| WO | 2001016854 | A2 | 3/2001 |
| WO | 2003076890 | A1 | 9/2003 |

* cited by examiner

MULTI ALARM REMOTE MONITORING SYSTEM

This is a National Stage Application of International Patent Application No. PCT/GB2015/054174, filed 29 Dec. 2015, which claims the benefit of and priority to Great Britain (GB) Patent Application No. 1423300.1, filed 29 Dec. 2014, the entireties of which are incorporated fully herein by reference.

FIELD OF THE INVENTION

This invention relates to a system for remotely monitoring safety alarms at an installation location, and determining and reporting an associated level of risk. The safety alarms may include heat detectors, carbon monoxide detectors, smoke detectors and other safety alarms. More specifically, the present invention relates to systems and methods using decision logic to manage the issuance of alert notifications based on a history of alarm event data, wherein the alarm event data comprise activation of an alarm, test procedures on the alarm or even a malfunction of the alarm.

BACKGROUND

A conventional arrangement in, for example, a domestic residence, involves stand-alone safety alarms. When activated, consequent to the relevant catalyst or alarm test procedure, an audible and/or visual alarm functions; this is known as an alarm event. An alarm event alerts the inhabitants or nearby individuals to take action. It is also known to have alarms, in particular smoke alarms, connected to the nearest fire station via the telephone network. In this case, activation of the smoke alarm at the residence, school, office or factory will cause a specific associated alert function to be triggered at the fire station.

U.S. Pat. No. 8,988,232 B1 discloses a method of determining an amount of time during which a hazardous condition is present, and generating an output in response to whether or not the amount of time has reached at least a threshold duration.

The time and date of an alarm event and the location and type of alarm that was activated, are data that is unique to each alarm event. Such information has considerable value which has not been recognised or utilised in conventional alarm systems.

It is an aim of the present invention to provide a safety alarm monitoring system which utilises historical alarm event information to determine a risk factor for a particular location and to communicate this risk factor to a third party.

SUMMARY OF THE INVENTION

According to a first aspect of the present invention, there is provided a remote alarm monitoring system as defined in claim 1.

The remote alarm monitoring system is configured for recording and processing alarm event data, the alarm system comprising: one or more alarm devices in connection with an interface, wherein the interface is configured to receive alarm event data; a server in communication with the interface, wherein the server is configured to receive and process alarm event data from the interface; and one or more networked client devices in communication with the server, wherein the server is configured to transmit a message to the networked client device, said message based upon the processed alarm event data.

In embodiments of the first aspect, the processed alarm event data is based on an analysis of the pattern and/or the frequency of alarm events and an assessment of a level of risk based on the analysis results.

It will be understood that the frequency of alarm events can be based on historical alarm event data, i.e., a history or record of past alarm events, of the one or more alarm devices.

In embodiments, the processed alarm event data is based on an analysis of the type of alarm events and an assessment of a level of risk based on the analysis results.

As specified below, alarm event data may include the date and time of the event, an identifier of the alarm device detecting the event and also the nature of the event, such as an activation of the alarm, a test procedure on the alarm or even a malfunction of the alarm. Alarm event data may include the date and time when an alarm is silenced (e.g., after a nuisance alert or test), or the time elapsed between an alarm event and the alarm being silenced.

The connection between the one or more alarm devices and the interface may be a wireless network connection.

Each of the one or more alarm devices may be configured to store alarm event data, the alarm event data including activation of an alarm, test procedures on the alarm or a malfunction of the alarm, for transmission to the server.

This allows alarm event data to be relayed once a reliable connection with the server has been established.

The one or more alarm devices may store alarm event data within each alarm device prior to transmission of the alarm event data to the interface.

The analysis of the pattern and/or the frequency of alarm events may take into account non-hazardous alarm events.

Non-hazardous alarm events include test functions, and the silencing of alarms in a non-hazardous situation. Non-hazardous alarm events may include time between an alarm event and the activation of the silencing function. Non-hazardous alarm events may include background sensor data, such as a pattern of sensor activity.

This increases the autonomy of an alarm device.

According to a second aspect of the present invention, there is further provided a server as defined in claim 6.

The server is configured for processing alarm event data, to receive alarm event data from an alarm installation via an interface; analyse the pattern, frequency, and/or type of alarm events; compare the analysed data with pre-determined criteria; and transmit a message to networked client device based on the comparison results.

In embodiments of the second aspect, the step of comparing the analysed alarm event data with the pre-determined criteria results in a risk-level specific to the installation.

The pre-determined criteria may include stored historical data specific to the associated installation.

The step of comparing the analysed alarm event data with the pre-determined criteria may result in a risk-level specific to the installation.

The pre-determined criteria may include stored historical data specific to the associated installation.

The pre-determined criteria may include ongoing analysis of the pattern, frequency and/or type of the alarm event data of the associated installation.

The server may take into account the number of non-hazardous alarm events when analysing the pattern and/or the frequency of alarm events.

According to a third aspect of the present invention, there is provided a method for remotely monitoring alarms as defined in claim 11.

The method comprises the steps of: receiving alarm event data at an interface from one or more alarm devices; transferring alarm event data from the interface to a server; processing the alarm event data; and transmitting a message to at least one networked client device based on the processed alarm event data.

As set out in more detail below, an interface may be integral with an alarm device.

In embodiments of the third aspect, the step of processing the alarm event data may comprise analysing the pattern, frequency and/or type of alarm events, and assessing the level of risk based on the analysis results.

The method for remotely monitoring safety alarms may further comprise the step of storing alarm event data locally at the one or more alarm devices for transmission to the server.

The method for remotely monitoring safety alarms may further comprise the steps of: storing alarm event data locally at the one or more alarm devices; and transmitting alarm event data from the alarm devices to the interface.

In the method for remotely monitoring safety alarms, the step of analysing the pattern and/or the frequency of alarm events may take into account the number of non-hazardous alarm events.

In this way, remote automated monitoring of safety alarms is efficiently achieved on a continuous basis.

Features of the embodiments of the first, second and third aspects may be combined. For instance, method steps in accordance with embodiments of the third aspect may be carried out using configurations of embodiments of the first aspect.

DESCRIPTION OF THE FIGURES

Embodiments of the invention will now be described, by way of example, with reference to the accompanying drawings, in which.

DESCRIPTION

Figure 1:
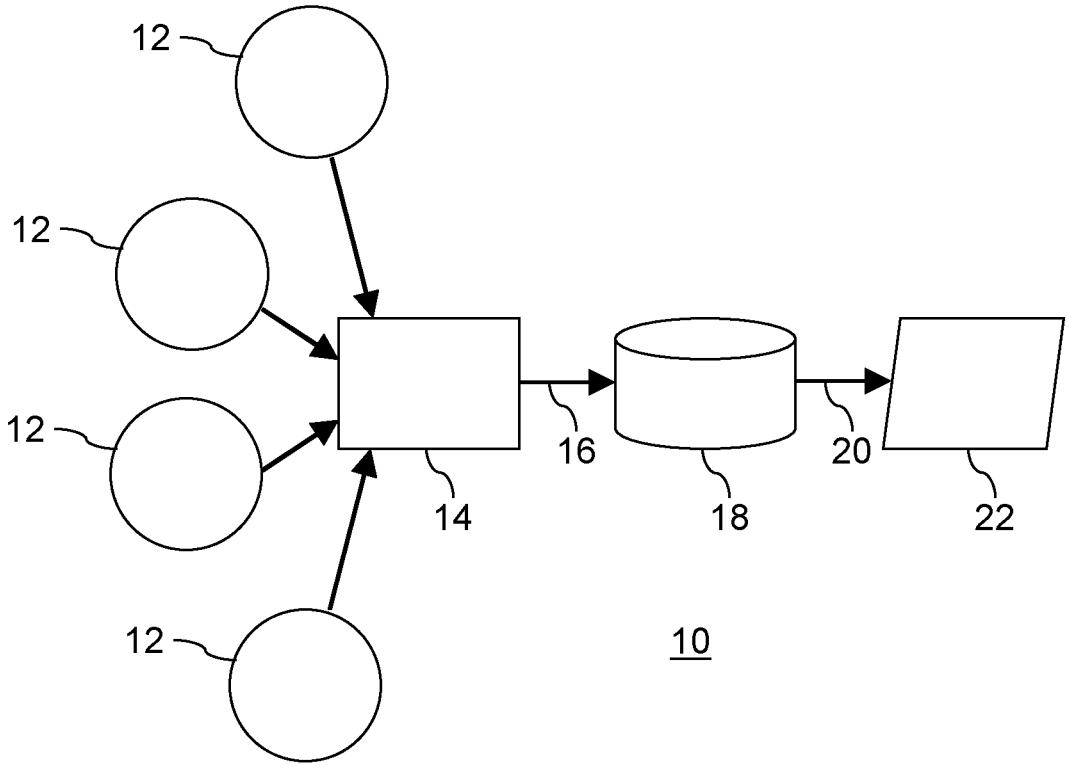
FIG. 1 is a schematic illustration of an alarm monitoring system in accordance with an embodiment of the present invention.

FIG. 1 schematically illustrates the alarm monitoring system 10 of the present invention. One or more alarms 12 (in FIG. 1: four alarm devices 12) installed in one or more locations comprises an alarm network. Data from the alarm network is transmitted via an interface 14 to a mobile telecommunications network 16 such as GSM, UMTS or via TCP/IP. The interface may be wired and/or wireless. The data is subsequently received by a cloud-based server 18.

The data from the one or more alarms 12 is referred to as alarm event data. Alarm event data specifies the date and time of the event and also the nature of the event, such as an activation of the alarm, a test procedure on the alarm or even a malfunction of the alarm.

It will be understood that an alarm 12 may be embodied in the form of a detector capable of determining a change in an environmental condition. The environmental condition may be a temperature level (heat), carbon monoxide level, smoke level, or other condition. The detector may be capable of monitoring a plurality of environmental conditions. If the environmental condition is outside permissible boundaries, the alarm indicates this locally by a signal, which may be audible and/or visual, in the form of an above-mentioned alarm event.

A detector is capable of monitoring its status. The status may indicate that the detector is operating within predetermined parameters, or that a fault has occurred. The status may include power status and/or sensor status. For instance, a detector may monitor whether or not its power supply is interrupted. A detector may monitor whether a battery level is too low. A detector may monitor whether a battery level is dropping at a faster rate than expected. A detector may monitor the performance of optical sensors. The status information may be included in the alarm event data. This may be used in the determination of a pattern in alarm event data.

The alarm is an autonomous device. By "autonomous", it is meant that the alarm can operate as a stand-alone device, independently of whether or not it is connected to a cloud based server 18. However, if a data connection between the alarm and the server 18 is established, alarm event data from the alarm device can be transmitted to the server 18.

The data is processed via an application running on the server 18 in which variables such as the number of alarm events over a period of time are analysed.

An analysis may take into account the type of the alarm. The alarm type may be determined by substance or condition monitored by the alarm. This may include smoke, heat, carbon monoxide, extreme temperatures, gas levels, pollution levels, or other.

An analysis may take into account the location of an alarm within the property. By location, the area monitored by the detector is meant. For instance, the location may be a floor level monitored by the alarm. The location may be classified by use, or intended use. A location may be a kitchen area. For instance, false alerts due to smoke from a toaster may be qualified differently in a kitchen area than in a non-kitchen area. A location may be a wet area. For instance, false alerts due to steam may be qualified differently in a bathroom.

An analysis may take into account the batch number of an alarm device or its condition.

Subject to the results of such analysis, a message 20 is automatically generated and transmitted via email, text message, or similar electronic means to a networked client device 22 of a predetermined recipient. The networked client device 22 may be a desktop computer, a laptop, a tablet or smartphone or similar. The networked client device 22 may be a device other than the alarm 12.

The application running on the server 18 is configured to analyse data from a single type of alarm 12 in one or more locations such as a residential building, school, office or factory to build a history of alarm events. Further, the application running on the server 18 is configured to also analyse data from multiple types of alarm 12 within a single location to build a history of alarm events.

The application is configured to analyse the history of alarm events to determine whether any patterns are evident. Patterns of repeated alarm events from a single location within a predetermined period of time may indicate a problem at that location which needs to be addressed. Specifically, a certain pattern is related to a certain degree of risk at a location, whilst a different pattern is related to a different degree of risk at a location. If the risk at a certain location is in excess of a pre-determined level, then a suitable message 20 is automatically sent to a predetermined recipient, i.e., to a third party, to be received on their mobile phone, landline, tablet, P.C. or other telecommunications means 22. The pre-determined level may vary installation by installation, dependent upon factors at each installation.

The predetermined recipient or responsible third party may be, by way of example, fire and rescue community care services or a relative of the fire alarm owner or an alarm maintenance service. The predetermined recipient or responsible third party may be a person or entity with an interest or under an obligation to monitor a number of buildings simultaneously, such as a private landlord, a social landlord, a property manager, a local authority or a housing association. The predetermined recipient or responsible third party may be a carer or relative.

The predetermined level may be embodied in the form of a risk threshold. A different risk threshold may be associated with different installations. For example, if one or more alarm devices 12 are installed in the kitchen of residential premises and if more than one smoke alarm events are recorded in the period of 10 days, then an alert will be sent to one or more communication devices 22 of the third party. For example, if the occupant is an elderly person living alone, then an appointed carer or relative will receive the alert. The alert can comprise various types and levels of information; the alert may specify the nature and times of the alarm events, or the alert may simply specify that a check of the premises is required by contacting or visiting the occupant.

Likewise, different risk thresholds may be associated for installations depending on the size, condition, and/or age of a property, the number of occupants, the occupation of occupants (e.g., student, retired), the age of occupants, health records, mental health, drug dependency, or any combination of these factors.

The interface 14 functions to transfer alarm event data from the alarm network to the internet or mobile telecommunications network 16. The interface 14 may be wireless or realised in hardware. For example, the interface 14 may comprise a broadband modem or home hub, or any other means of transferring data from the system alarms 12 to the internet or mobile telecommunications network 16.

A single location, such as a residence, school building office building or factory may have several safety alarms installed. These alarms 12 may have various positions within a building and various types of safety alarm may be installed. Each alarm 12 can be uniquely identified in the monitoring system of the present invention. A log of alarm events can be stored on a microchip within each alarm device 12 and then transmitted periodically to the interface 14. Alternatively, each alarm event which occurs at an alarm device 12 can be transmitted instantaneously to the interface 14.

It is known for safety alarms to have a device test function, comprising a button that may be depressed to establish that the device is correctly functioning. Therefore, an alarm event which may be monitored using the present invention, is activation of the test function of an alarm. For example, it may be helpful for the responsible third party to know that their elderly ward is repeatedly pressing the test button, i.e., with a higher frequency than would normally be expected, as this may indicate that the elderly person is concerned about the functioning of the alarm thereby causing them worry or stress.

When a safety alarm event occurs inappropriately, this may be referred to as a nuisance alarm. An example of such a nuisance alarm is the activation of a smoke alarm by regular cooking fumes. Consequently, the user would press the reset button on the alarm body in order to silence the alarm as there is no immediate danger. The present invention may record the time lapse between the safety alarm event and the activation of the reset function. The skilled person will understand that such behavioural data is valuable for analysing the risk factor at a location. For example, a nuisance alarm may be promptly noted and silenced by the user pressing the reset button, or a nuisance alarm may only be reset after a prolonged period, or not all. In either example, the amount of time taken to reset the alarm in combination with other factors (such as the installation location) is used to determine a level of risk at a location.

Each safety alarm 12 installed in the system 10 of the present invention is provided with the facility to store a log of alarm events on a non-volatile memory within the alarm electronics located within the housing of the alarm. Further, each safety alarm 12 has the facility to transmit the alarm event data over a wireless network.

Figure 2:
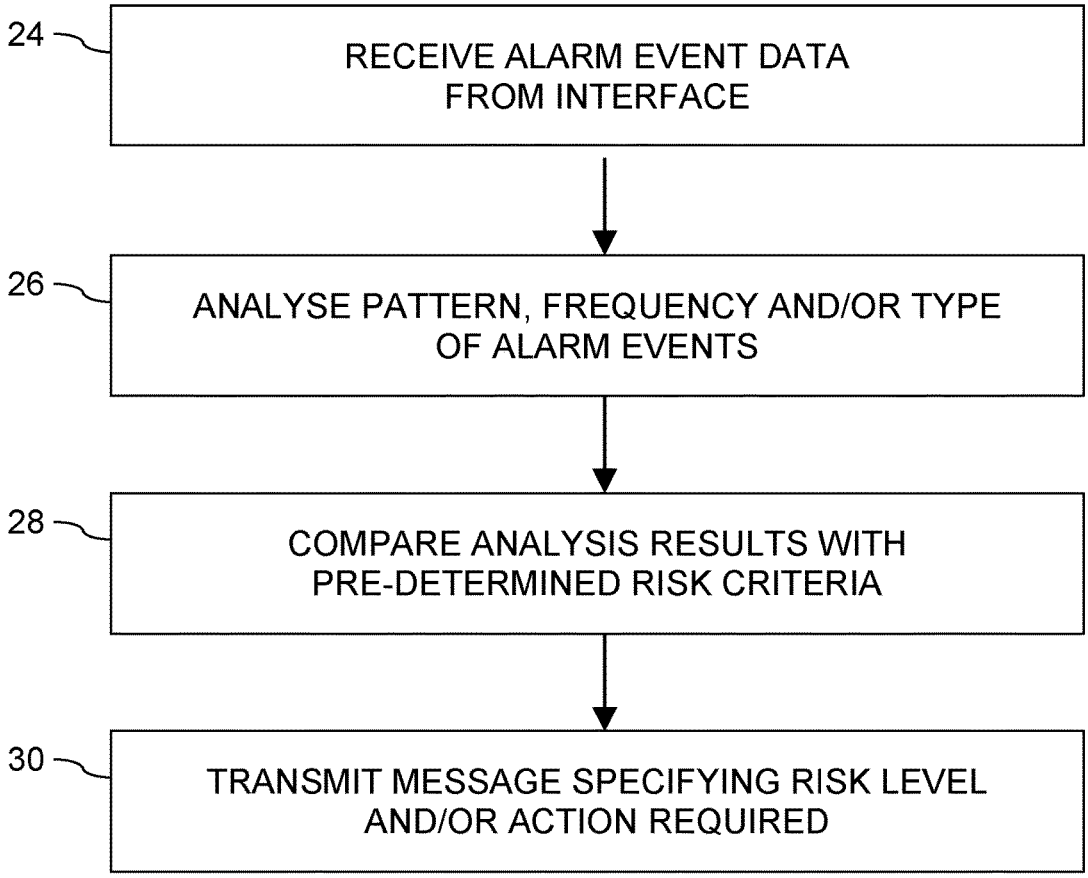
FIG. 2 is a process diagram of the steps performed at the server by the algorithm of the present invention.

FIG. 2 illustrates the steps of a method for processing the alarm event data. The first step 24 comprises receipt of alarm event data from the interface. The second step 26 comprises an analysis of the pattern, frequency and/or type of alarm events. In the third step 28, the analysis results are compared with predetermined risk criteria. The fourth step 30 comprises transmitting a message to a specific networked client device of a third party specifying a risk level at the installation and/or action to be taken by the third party.

The method steps recited in FIG. 2 are realised by an algorithm of the present invention running on the cloud-based server 18.

It is envisaged that a single commercial entity may provide an entire service in respect of the present invention. Specifically, it is envisaged to provide and install the safety alarm or alarms at one or more premises and provide the network infrastructure to support the remote monitoring function. Further, embodiments of the invention allow to determine, and subsequently update, the predetermined risk criteria in respect of each alarm installation. This may be achieved through consultation with the responsible third party, who, in many cases, may also be the customer or manager of the commercial entity. Equally, different commercial entities may provide various parts of the alarm installation and remote monitoring service.

A risk profile may be assigned upon installation of an alarm device. The same risk profile may be assigned to a group of alarm devices based on similar classification criteria. For instance, the risk profile may be assigned on the basis of factors including whether or not alarm devices 12 belong to the same alarm system 10, the property type (e.g., residential or commercial), the location within a property, and any of the above-listed criteria, such as number, occupation, and/or number and age of occupants. The factors may be based on fire and rescue services policies, and/or on regional considerations. The risk profile may be set manually. It may be suitable to use one of three risk levels, such as "low", "medium", "high". Any number of risk levels may be set, as appropriate for a type of installation or as required by a third party.

As the application is configured to determine alarm event patterns from an analysis of historical alarm events, this allows the risk profile for a given installation to be adjusted based on an alarm event pattern. For instance, an installation with an initially low risk profile may be assigned a higher risk profile when a higher frequency of alarm events is observed.

Likewise, a change in an alarm event pattern may indicate an underlying problem that, in itself, is not sufficiently critical to raise a local hazard alert, but that merits a notification to a third party. For instance, an elderly person may customarily test an alarm device once per week as part of their routine (e.g., every Friday morning). A deviation from the routine (e.g., irregular test at different times of the day and unusually frequent tests throughout the week) may indicate an underlying health issue, such as incipient Alzheimer's disease. A deviation from the routine may be noticeable by a change of the alarm event pattern (and/or frequency). An algorithm can pick up such a change and issue a notification message to a third party.

Likewise, an algorithm may take into account a change in the duration required to silence a nuisance alarm, as described above. For instance, it may be expected that a nuisance alarm is silenced within a short period of time (e.g., within less than a minute). If the response time deviates from the expected range (e.g., it takes much longer than a minute to silence a nuisance alarm), this may indicate an underlying issue.

The algorithm may take into account a combination of two or more different triggers (e.g. both a change in test behaviour and a change in the response time to a nuisance alarm), or any number of types of alarm events.

The algorithm may provide as part of the alert notification an output suggesting a more appropriate risk level, e.g., a higher risk level (from low to medium, or from low to high, or from medium to high), for a third party to set manually.

To better illustrate this with an example, an installation may be assigned one of three risk levels, such as low risk, medium risk, or high risk. An alarm event will elicit a different response depending on the risk level of the installation. For instance, in a low risk installation, an alarm event may be recorded without a message 22 being sent to a third party. In a medium risk installation, the same alarm event may cause the alarm system to generate a notification message to a warden. In a high risk installation, the same alarm event may cause the alarm system to alert a fire and rescue service.

To provide an example for a low risk installation, a typical alarm event may be a smoke alert in a kitchen. A smoke alarm in a student accommodation may be classified as a low risk installation. If a single smoke alarm event (e.g., a nuisance alarm) is detected by a single alarm device, this will be recorded as an alarm event by the server, but no alarm message 20 is sent to a third party. If, however, two or more smoke alarm events are detected within a predetermined time window, or by two alarm devices in close proximity, this may indicate a problem and the server will issue an alarm message 20 to alert to a third party. For instance, a warden may be alerted of a repeat smoke alarm instance.

To provide an example of a high risk installation, a smoke alarm in a vulnerable person's home may be classified as a high risk installation. In that case, the single smoke alarm event by a single alarm device is relayed as an alert to a third party. For instance, an alert may be relayed directly to a fire and rescue service.

As set out above, alarm event data may include non-hazardous conditions, such as test procedures or status messages indicating a malfunction of an alarm device. The alarm device may be configured not to indicate a warning message of the non-hazardous condition if the alarm event data can be relayed to a server.

To provide another example, if an alarm device is silenced repeatedly, i.e., with a higher frequency than would normally be expected, the alarm system allows each silencing to be recorded as an alarm event. Depending on the risk profile, a pre-alert or alert may be sent in the form of a message 20 to a third party if the number of silencing events occurs too frequently (e.g., more than 3 times a day).

Notably, it is not necessary for the alarm device 12 to sound an alert. For instance, a message 20 may be generated because a test button is pressed too frequently. In alarm systems with isolated alarm devices, it was hitherto not known to utilise such alarm event data in the determination of a risk factor. The alarm system of the present invention allows alarm event data of non-hazardous conditions to be included in the determination of whether or not a hazard is present.

Non-hazardous alarm events may include background sensor data, such as a pattern of sensor activity. For instance, a sensor of an alarm device may monitor a hazard level, and may routinely be configured to sound an alert if the hazard level exceeds a pre-determined threshold level ("trigger level"). The alarm event data may include background sensor data that was below the trigger level. For instance, the alarm event data may include the time, date, and other alarm device data for each time the hazard level exceeded 50%, or ⅔, of the trigger level. As such, the pattern of sensor activity may be elevated above background noise but not be high enough to trigger an alert locally. Thus, the hazard level will not be expected to cause an alarm device to sound an alert locally. However, the pattern may be analysed by the server as significant to merit notifying a third party. The server may, accordingly, send a notification to a third party. This provides an opportunity for the third party to investigate the issue.

For instance, an increasing number of non-hazardous alarm events may indicate a deterioration of an environment and may justify calling a service engineer or warden to inspect the situation at the premises.

In embodiments in which the batch number of the alarm device is taken into account in the analysis of the risk factor, this allows to determine whether or not a repeat number of false alarm events occurs in a particular batch of alarm devices.

This may indicate a degradation in detector performance. Likewise, patterns may be indicative of whether or not scheduled tests have been carried out in the required intervals, or whether a battery level is too low.

Thereby, fault conditions may be spotted that are not critical to the normal operation of the alarm device. This allows servicing to be initiated, or may encourage a targeted maintenance of detectors according to their classification (e.g., location, batch number, age of occupants, etc).

The decision logic may consider the alarm event history of the last 3, 4, 5, 6 days or of the last week. The decision logic may consider the alarm event history of the last two, three, four weeks or of the last month. The decision logic may take into account different days of the week or times of the year. For instance, student accommodation may be used for students during term time and as guest accommodation during a holiday season. The risk profile may be set to one level during term time, when students are expected to occupy the accommodation, and to another level when guests are present during holiday season.

The skilled person will understand that numerous modifications and variations to the exemplary embodiments are possible within the scope of the present invention. For example, two or more features of the alarm system illustrated in FIG. 1 may be combined in a single unit. This includes the combination of an alarm 12 including an interface 14 within the alarm housing. In other words, interface 14 may be constituted by the communication setup between an alarm device 12 and the server 18, as illustrated in FIG. 1. The interface 14 may be integral with an alarm device 12, such that each alarm device 12 has, via an integral interface 14, a direct communication channel via network 16 with the server 18. The interface 14 of an alarm device 12 may serve as intermediary to relay data from one or more other alarm devices 12 of an alarm system. This allows data of alarm devices without direct connection to a server to be relayed via one or more alarm devices that are in direct communication with the server 18.

As such, the interface 14 may be configured to store alarm event data of a plurality of alarm devices 12.

Furthermore, the predetermined risk criteria can be reassessed on an ongoing basis, either automatically via the application running in the server or with the addition of manual input. Modifications and variations to the algorithms comprising the application are an integral aspect of the present invention.

It will be understood that when the present specification refers to decision logic in an embodiment, the decision logic may be embodied in the form of an algorithm. Embodiments of the invention may comprise a processor and software instructions implemented by the processor to apply the decision logic or algorithm.

The invention claimed is:

1. A remote alarm monitoring system for recording and processing alarm event data, the alarm system comprising:

at least one alarm device in connection with an interface, wherein the interface is configured to receive alarm event data;

a server in communication with the interface, wherein the server is configured to receive and process alarm event data from the interface; and at least one networked client device in communication with the server, wherein the server is configured to transmit a message to the networked client device, said message based upon the processed alarm event data and an analysis of a risk level assigned to the at least one alarm device.

2. The alarm system according to claim 1, wherein the processed alarm event data is based on an analysis of at least one of a pattern and a frequency of alarm events and wherein the alarm system is configured to adjust the risk level based on an alarm event pattern.

3. The alarm system according to claim 2, wherein the analysis of at least one of the pattern and the frequency of alarm events takes into account non-hazardous alarm events.

4. The alarm system according to claim 1, wherein the processed alarm event data is based on an analysis of a type of alarm event and wherein the alarm system is configured to adjust the risk level based on an alarm event type.

5. The alarm system according to claim 1, wherein each of the at least one alarm devices is configured to store alarm event data, the alarm event data including activation of an alarm, test procedures on the alarm or a malfunction of the alarm for transmission to the server.

6. The alarm system according to claim 1, configured to elicit a different response for the same alarm event depending on the risk level.

7. The alarm system according to claim 1, wherein the interface is integral with the alarm device.

8. A server for processing alarm event data, the server configured to:

receive alarm event data from an alarm installation via an interface;

analyse at least one of a pattern, a frequency and a type of alarm event;

compare the analysed data with pre-determined criteria; and transmit a message to a networked client device based on results of the comparison and an analysis of a risk level assigned to the alarm installation.

9. The server according to claim 8, wherein the step of comparing the analysed alarm event data with the predetermined criteria results in a risk-level specific to the installation.

10. The server according to claim 8, wherein the predetermined criteria includes stored historical data specific to an associated installation.

11. The server according to claim 10, wherein the predetermined criteria includes ongoing analysis of at least one of the pattern, the frequency, and the type of the alarm event data of the associated installation.

12. The server according to claim 8, wherein in analysing at least one of the pattern and the frequency of alarm events, the server takes into account at least one of a number and a type of non-hazardous alarm events.

13. The server according to claim 8, configured to elicit a different response for the same alarm event depending on the risk level.

14. A method for remotely monitoring alarms, comprising the steps of:

receiving alarm event data at an interface from at least one alarm device;

transferring alarm event data from the interface to a server;

processing the alarm event data based on an analysis of a risk level assigned to the at least one alarm device; and transmitting a message to at least one networked client device based on the processed alarm event data.

15. The method according to claim 14, wherein the step of processing the alarm event data comprises:

analysing at least one of a pattern, a frequency and a type of alarm event;

assessing the risk level based on the analysis results.

16. The method according to claim 15, further comprising the step of:

storing alarm event data locally at the at least one alarm device for transmission to the server.

17. The method according to claim 15, wherein the step of analysing at least one of the pattern and the frequency of alarm events takes into account at least one of a number and a type of non-hazardous alarm events.

18. The method according to claim 15, comprising adjusting the risk level based on an alarm event pattern.

19. The method according to claim 15, comprising eliciting a different response for the same alarm event depending on the risk level.

* * * * *